US006766756B1

(12) United States Patent
Cardaci

(10) Patent No.: US 6,766,756 B1
(45) Date of Patent: Jul. 27, 2004

(54) TOWING ASSEMBLY FOR PERSONAL WATERCRAFTS

(76) Inventor: Anthony Cardaci, 61-25 164$^{th}$ St., Flushing, NY (US) 11365

( * ) Notice: Subject to any disclaimer, the term of this patent is extended or adjusted under 35 U.S.C. 154(b) by 0 days.

(21) Appl. No.: 10/410,049

(22) Filed: Apr. 9, 2003

(51) Int. Cl.$^{7}$ ..... B63B 21/58
(52) U.S. Cl. ..... 114/250
(58) Field of Search ..... 114/230.15, 249, 114/250, 242; 280/493, 494

(56) References Cited

U.S. PATENT DOCUMENTS 2,738,525 A * 3/1956 Roberts ..... 441/72
3,353,512 A * 11/1967 Mathews et al. ..... 114/250
3,651,778 A * 3/1972 Derecktor ..... 114/250
4,768,803 A 9/1988 Hewitt et al.
4,947,779 A * 8/1990 Grinde ..... 114/250
5,524,914 A 6/1996 Doherty et al.
5,873,595 A * 2/1999 Hinte ..... 280/504
5,881,665 A 3/1999 Ratcliff
6,295,943 B1 * 10/2001 Brushaber et al. ..... 114/253

* cited by examiner

*Primary Examiner*—Andrew Wright
(74) *Attorney, Agent, or Firm*—Goldstein Law Offices, P.C.

(57) ABSTRACT

A towing assembly for use in towing personal watercrafts. The assembly has a yoke, a leading bar, and a pair of trailing bars, the bars being pivotally attachable to the yoke. The leading bar is selectively attached to an eye hook at the bow of the boat being towed and the trailing bars are selectively attached to eye hooks at the stern of the towing boat. The free end of each bar has an attachment mechanism for securing the bars to the respective boats. Each attachment mechanism is secured to the respective bar with a swivel joint, thereby allowing the attachment mechanism to move independent of the bars.

8 Claims, 4 Drawing Sheets

TOWING ASSEMBLY FOR PERSONAL WATERCRAFTS

BACKGROUND OF THE INVENTION

The invention relates to a towing assembly for use with personal watercrafts. In particular, the invention is an assembly of pivotable bars wherein one end of the assembly is attachable to the boat to be towed and the opposite end of the assembly is attachable to the towing boat, thereby preventing contact between the two boats.

Boating has become a popular mode of transportation for many people. Boats are often used for recreational purposes, by fisherman, and by coast guard officials. Part of the responsibility of boating includes maintaining the boat and filling the tanks up with gas as necessary. However, as many boat owners and users have experienced, it is common for the boat to break down while on the water due to mechanical malfunctions and running out of gas. When this occurs, it is necessary to have another boat tow the stranded boat to dock.

Towing another boat can be a difficult task, especially during high winds and in choppy waters. A tow line is typically utilized, said line being attached to both boats. The stranded boat is then towed in by the towing boat. This practice can often cause damage to both boats since it is common for the towed boat to bump into the towing boat. Many individuals also sustain injuries during the towing when attempting to fend off the other boat to prevent damage.

Thus, there exists a need for a towing assembly that may be used with personal watercrafts without causing damage to either boat during use. Such an assembly is attachable to existing eye hooks in the boats' sterns and bows. The assembly provides a plurality of rigid bars that prevent the boats from coming into contact with each other. Further, the towing assembly is pivotable, thereby allowing the boats to be maneuvered as necessary.

U.S. Pat. No. 5,524,914 to Doherty et al. discloses a trailer hitch and tow bar for use with personal watercrafts. The bar is mounted on the deck of the watercraft and the opposite end is secured to the underside of a trailer.

U.S. Pat. No. 4,768,803 to Hewitt et al. discloses a jointed tow bar for towing one vehicle by a second vehicle. The bar is attached to a towing mechanism on the vehicle.

U.S. Pat. No. 5,881,665 to Ratcliff discloses a towable recreational watercraft having an effective and convenient steering system. The tow bar extends over the hull of the watercraft and is operated by a steering system.

While these units may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved towing assembly for use with personal watercrafts. As such, the general purpose of the present invention, which will be described subsequently in greater detail, is to provide a new and improved towing assembly which has all the advantages of the prior art and none of the disadvantages.

To attain this, the present invention essentially comprises a towing assembly for use in towing personal watercrafts. The assembly has a yoke, a leading bar, and a pair of trailing bars, the bars being pivotally attachable to the yoke. The leading bar is selectively attached to an eye hook at the bow of the boat being towed and the trailing bars are selectively attached to eye hooks at the stern of the towing boat. The free end of each bar has an attachment means for securing the bars to the respective boats. Each attachment means is secured to the respective bar with a swivel joint, thereby allowing the attachment means to move independent of the bars.

It is an object of the invention to produce a towing assembly that allows a boat to be towed by a second boat without causing damage to either watercraft. Accordingly, the assembly comprises a plurality of rigid bars that attach to both boats. The bars maintain a set distance between the boats during towing.

It is a further object of the invention to produce a towing assembly that aids in the maneuvering of the towed boat to dock. According, the assembly bars are pivotally attached to each other to allow for movement thereabout.

It is a still further object of the invention to provide a towing assembly that may be compactly stored. Accordingly, the trailing bars can be pivoted substantially 180 degrees into a collapsed position so that the leading bars and the trailing bars extend in the same direction, substantially parallel to each other.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

Figure 1:
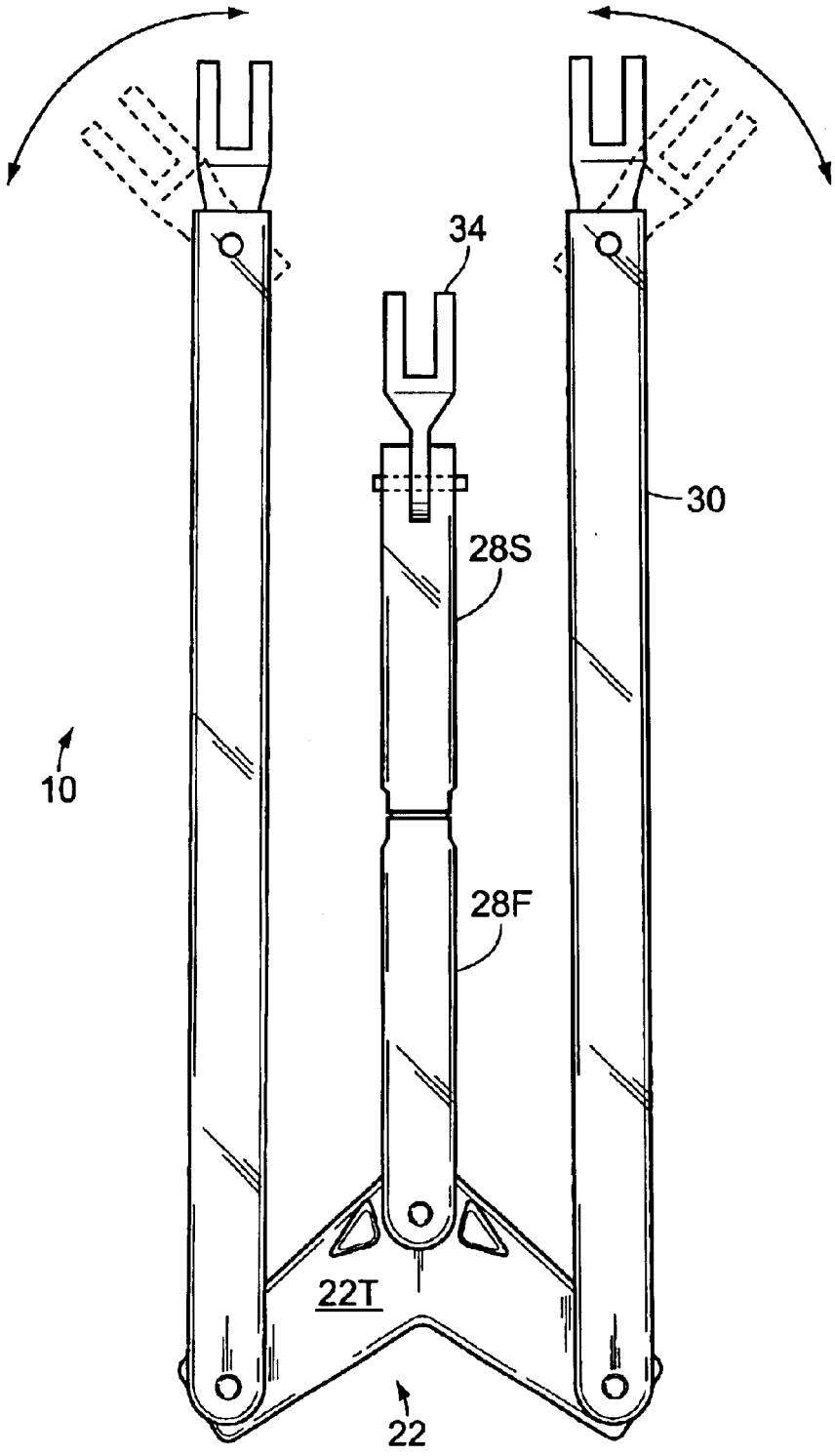
FIG. 1 is a top plan view of the towing assembly in a collapsed position.

| REFERENCE NUMERALS | |
|---|---|
| 10 | towing assembly |
| 12 | boat |
| 14 | boat stern portion |
| 14S | transom |
| 16 | boat bow portion |
| 16S | boat bow underside |
| 18 | eye hook |

-continued

| REFERENCE NUMERALS | |
|---|---|
| 22 | yoke |
| 22T | yoke plate |
| 24 | yoke leading point |
| 26 | yoke trailing point |
| 28 | leading bar |
| 28F | leading bar first portion |
| 28S | leading bar second portion |
| 28A | leading bar attached end |
| 28B | leading bar free end |
| 30 | trailing bar |
| 30A | trailing bar attached end |
| 30B | trailing bar free end |
| 32 | stopper |
| 34 | U-shaped clamp |
| 35 | U-shaped clamp prong |
| 36 | through bolt |
| 37 | prong hole |
| 40 | nut |
| 42 | swivel joint |

DETAILED DESCRIPTION OF THE PREFERRED EMBODIMENTS

FIGS. 1–5 illustrate a towing assembly 10 for use with personal watercrafts 12. The personal watercraft 12 has a stern portion 14 and a bow portion 16, wherein the bow portion 16 has an underside 16S, and the stern portion 14 has a transom 14S. The stern portion 14 has a pair of eye hooks 18 on the transom 14S, and the bow portion 16 has one central eye hook 18 on the bow underside 16S. The towing assembly 10 essentially comprises a leading bar 28, a pair of trailing bars 30, a yoke, wherein said bars 28, 30 are pivotally attachable to the yoke. The leading bar 28 is selectively attached to the eye hook 18 at the bow 16 of the boat being towed and the trailing bars 30 are selectively attached to the eye hooks 18 at the stern 14 of the towing boat, as will be described in greater detail hereinafter.

The yoke 22 is preferably "V" shaped, as illustrated in the drawing figures, having a top plate 22T, a leading point 24 and a pair of trailing points 26. The leading point 24 is located between and forward of the trailing points 26 on the yoke plate 22T, yet actually faces rearward during a towing operation.

Figure 3:
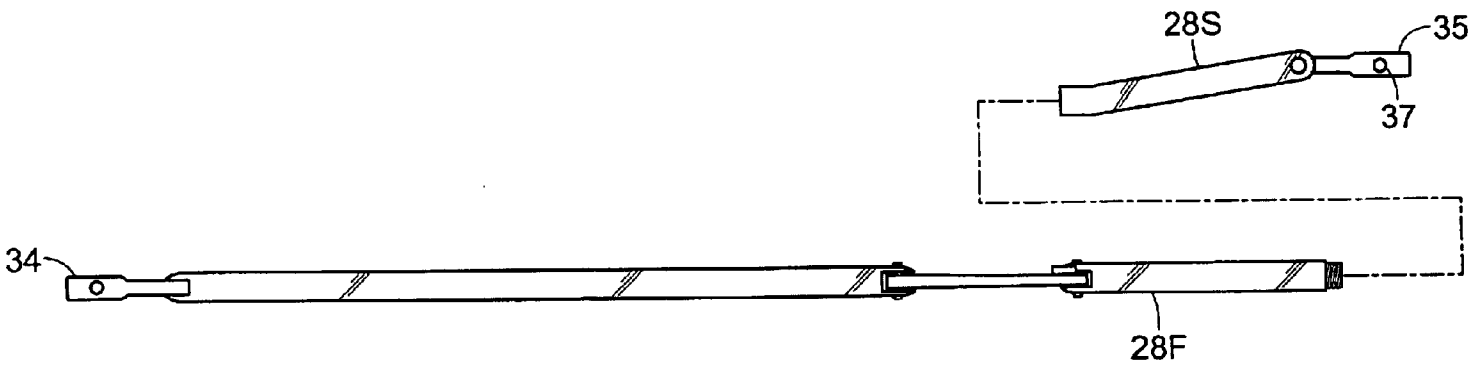
FIG. 3 is a side elevational view of the towing assembly, illustrating attachment of the leading bar second portion to the leading bar first portion.

The leading bar 28 extends from the yoke leading point 24, and the pair of trailing bars 30 extend from the yoke trailing points 26. Each bar 28, 30 has a pair of ends, wherein one end 28A, 30A is pivotally attached to the yoke 22, and the free end 28B, 30B is selectively attached to the respective boat. The leading bar 28 has two portions which are selectively mated together, as illustrated in FIG. 3. The first portion 28F of the leading bar 28 is attached to the yoke 22 and has threading on the exterior thereof. The second portion 28S is internally threaded for mating with the first portion 28F, said second portion is bent, so that it is angled upward from the first portion 28F when mated therewith. Thus, the leading bar 28 reaches upward towards the bow portion 16 of the boat being towed, since eye hooks 18 on the bow underside 16S are generally higher than the eye hooks 18 on the transom 14S.

Figure 2:
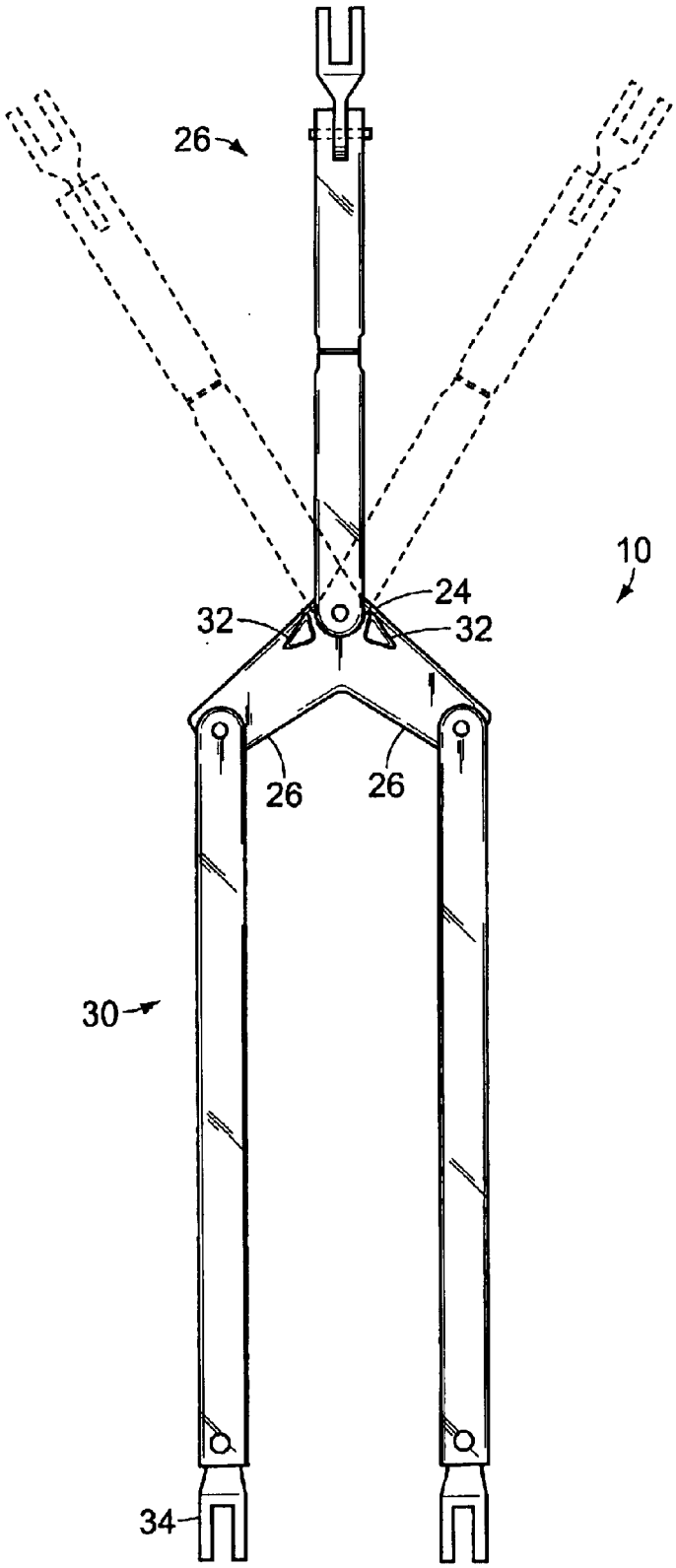
FIG. 2 is a top plan view of the towing assembly in an extended position wherein the trailing bars have been pivoted substantially 180 degrees, illustrating the angular movement of the leading arm about the yoke, permitted between the stoppers.
Figure 5:
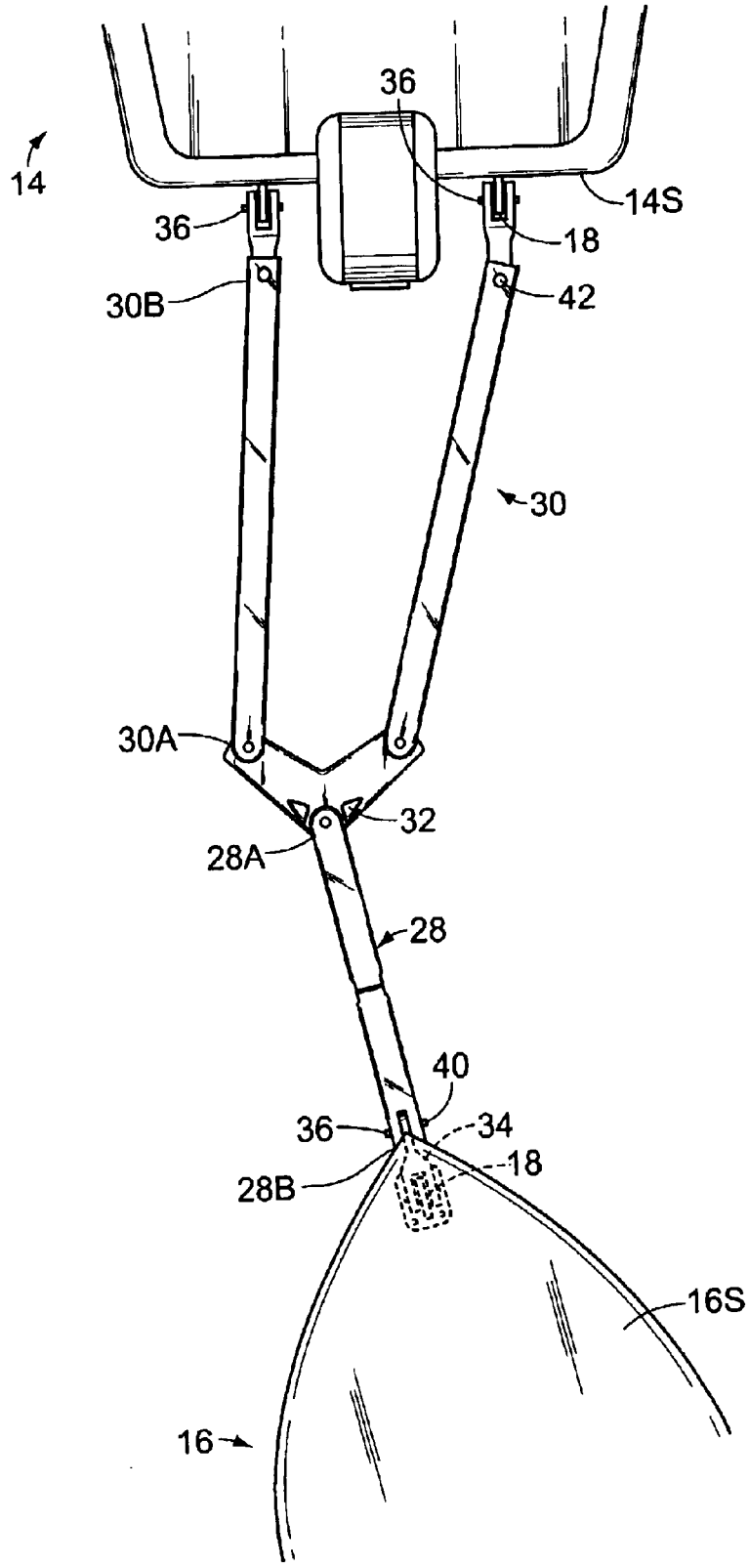
FIG. 5 is a top plan view of the towing assembly wherein the leading bar is attached to a stranded boat bow portion and the trailing bars are attached to a towing boat stern portion.

When in use, as illustrated in FIG. 2, the trailing bars 30 extend in an opposite direction from the leading bar 28. Referring to FIG. 5, in this position, the trailing bars 30 are attachable to the towing boat while the leading bar 28 is attachable to the boat being towed.

Each bar 28, 30 is pivotally attached to the yoke plate 22T, thereby allowing movement of the bars 28, 30 about the yoke 22 in a parallel plane as the top plate 22T. A pair of stoppers 32 are positioned on either side of the leading bar 28 which limit the angular movement of the leading bar 28 within an acute angular range, as illustrated by the phantom positions of the leading bar 24 shown in FIG. 2.

The free end of each bar 28B, 30B has an attachment means for securing the assembly 10 to the respective boat. The attachment means are preferably U-shaped clamps 34 that are mateable with the boat eye hooks 18. Each clamp 34 is secured to the respective bar 28, 30 with a swivel joint 42, thereby allowing the clamp 34 to pivot transverse to the bar 28, 30 on which said clamp 34 is attached.

Each clamp 34 is fitted over the corresponding eye hook 18 and a through bolt 36 is utilized to hold the clamp 34 in place, the through bolt having a threaded body. In particular, each clamp 34 has a pair of parallel prongs 35. The prongs 35 each have a prong hole 37 such that the prong holes 37 of each clamp 34 are axially aligned. A nut 40 is mated with the threaded body 38 of the bolt 36 to lock the clamp 34 in place wherein the bolt 36 also extends through the eye hook 18. Alternatively, one of the prong holes 37 can be internally threaded eliminating the requirement for a nut 40 to fasten the bolt 36 between the prongs 35, and thus fasten the clamp 34 to the eye hook 18.

Figure 4:
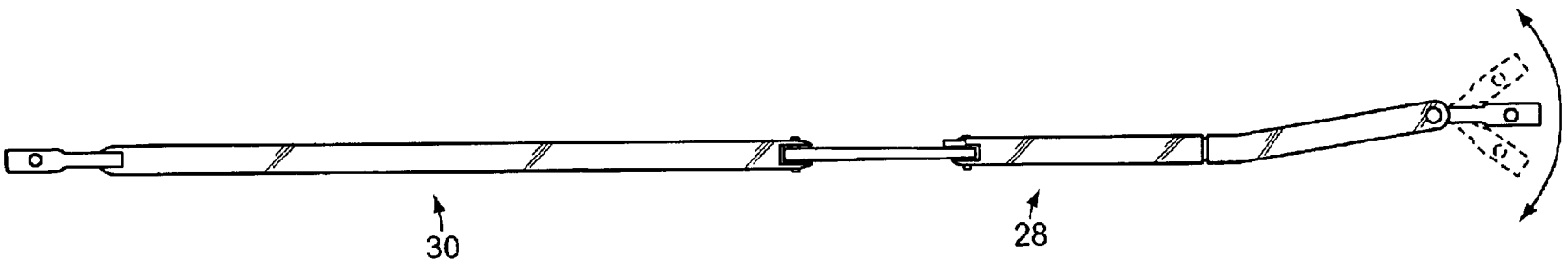
FIG. 4 is a side elevational view of the towing assembly, illustrating pivotal movement of one of the U-shaped clamps with respect to the leading bar.

In use, the clamp 34 of the leading bar 28 is fitted about the eye hook 18 on the bow portion 16 of the boat being towed, and the clamp 34 of each trailing bar 30 is fitted about the eye hooks 18 on the stern portion 14 of the towing boat, as illustrated in FIG. 4. Each clamp 34 is secured in place with a bolt 36 and nut 40. The towing boat then leads the boat being towed, pulling same therealong. After reaching dock, the towing assembly 10 is removed from both boats and may be collapsed for each storage, as illustrated in FIG. 1.

In conclusion, herein is presented a towing assembly for use with personal watercrafts. The invention is illustrated by example in the drawing figures, and throughout the written description. It should be understood that numerous variations are possible, while adhering to the inventive concept. Such variations are contemplated as being a part of the present invention.

What is claimed is:

1. A towing assembly for use with a towing boat to aid the towing boat in towing a stranded boat, the towing boat and the stranded boat each having a stern portion and a bow portion, the stern portion having a pair of eye hooks, and the bow portion having one central eye hook, comprising:

a yoke, the yoke having a top plate, a leading point, and a pair of trailing points, wherein the leading point is located between and forward of the trailing points on the top plate;

a leading bar, the leading bar pivotally secured to and extending outward from the yoke leading point, said leading bar having an attached end secured to the yoke and a free end for selectively attaching to the stranded boat, the free end having an attachment means for securing the leading bar to the stranded boat; and a pair of trailing bars, the pair of trailing bars pivotally secured to and extending outward from the yoke trailing points, wherein the trailing bars are positioned in an opposite direction from the leading bar, said trailing bars each having an attached end secured to the yoke and a free end for selectively attaching to the towing boat, each free end having an attachment means for securing the trailing bars to the towing boat.

2. The towing assembly as recited in claim 1, wherein the bar free end attachment means are U-shaped clamps mateable with the boat eye hooks by extending a bolt through each of the U-shaped clamps and its respective eye hook.

3. The towing assembly as recited in claim 2, wherein each U-shaped clamp is secured to the respective bar with a swivel joint, thereby allowing the clamp to pivot transverse to the bar on which said clamp is attached.

4. The towing assembly as recited in claim 3, wherein each clamp has a pair of parallel prongs and a pair of prong holes which are axially aligned to allow a bolt to extend through one of the prong holes, through one of the eye hooks, and then through the other of the prong holes to attach said clamp to said eye hook.

5. The towing assembly as recited in claim 4, wherein the yoke further comprises a pair of stoppers, the stoppers being positioned on opposite sides of the leading bar near the leading point, said stoppers limiting the angular movement of the leading bar attached at the yoke leading point within an acute angular range.

6. The towing assembly as recited in claim 5, wherein the trailing bars are capable of pivoting substantially 180 degrees so that they extend parallel to the leading bar for compact storage of the towing assembly.

7. The towing assembly as recited in claim 6, wherein the leading bar further comprises two portions, namely a first portion and a second portion, wherein the two portions are mated together, the first portion being attached to the yoke leading point and substantially coplanar with the trailing bars, and the second portion being angled upward from the first portion.

8. A method of towing a stranded boat with a towing boat using a towing assembly, the stranded boat having a bow portion and a central eye hook positioned at said bow portion, the towing boat having a stern portion and a pair of eye hooks positioned at said stern portion, the towing assembly comprising, a yoke, a leading bar attached to the yoke, and two trailing bars attached to the yoke, each bar having an attachment means, comprising the steps of:

positioning the towing assembly for attachment to the boats by extending the leading bar in an opposite direction from the trailing bars;

securing the leading bar attachment means to the stranded boat bow portion eye hook;

securing each of the trailing bar attachment means to the towing boat stern portion eye hooks; and towing the stranded boat by pulling the stranded boat with the towing boat.

* * * * *